United States Patent [19]

Snyder

[11] Patent Number: 4,797,776

[45] Date of Patent: Jan. 10, 1989

[54] FURNACE TEMPERATURE SAFETY SYSTEM

[75] Inventor: William J. Snyder, White Plains, N.Y.

[73] Assignee: Union Carbide Corporation, Danbury, Conn.

[21] Appl. No.: 48,879

[22] Filed: May 12, 1987

[51] Int. Cl.[4] ..... F23N 5/24

[52] U.S. Cl. ..... 361/103; 236/78 B; 236/DIG. 2; 236/15 R; 110/190; 431/16; 432/36

[58] Field of Search ..... 236/15 BR, 15 BD, 15 C, 236/15 E, 15 BF, 47, 99 E, DIG. 2, DIG. 3, DIG. 4, DIG. 8, 1 R, 1 A, 788, 94; 364/477, 557; 432/38, 36, 46; 110/185, 190; 165/11.1; 431/13, 14, 15, 16, 24

[56] References Cited

U.S. PATENT DOCUMENTS

| | | | |
|---|---|---|---|
| 2,788,175 | 4/1957 | Bourek et al. | 236/15 BR |
| 3,430,856 | 3/1969 | Engelhard | 236/15 BR |
| 4,296,727 | 10/1981 | Bryan | 236/15 BR |

OTHER PUBLICATIONS

"Alnor", Illinois Testing Laboratories, Inc. "Alnor Pyrotac Automatic Protection" Product Bulletin 4703-10M, Apr. 1952.

Complete Temperature Measurement Handbook and Encyclopedia, OMEGA Engineering, Inc. pp. 17, 18 (1985).

*Primary Examiner*—A. D. Pellinen
*Assistant Examiner*—H. L. Williams
*Attorney, Agent, or Firm*—Stanley Ktorides

[57] ABSTRACT

A system to continually monitor the integrity of control and safety thermocouples within a furnace comprising a low furnace temperature reader connected in parallel with a high furnace temperature reader to a single safety thermocouple.

16 Claims, 1 Drawing Sheet

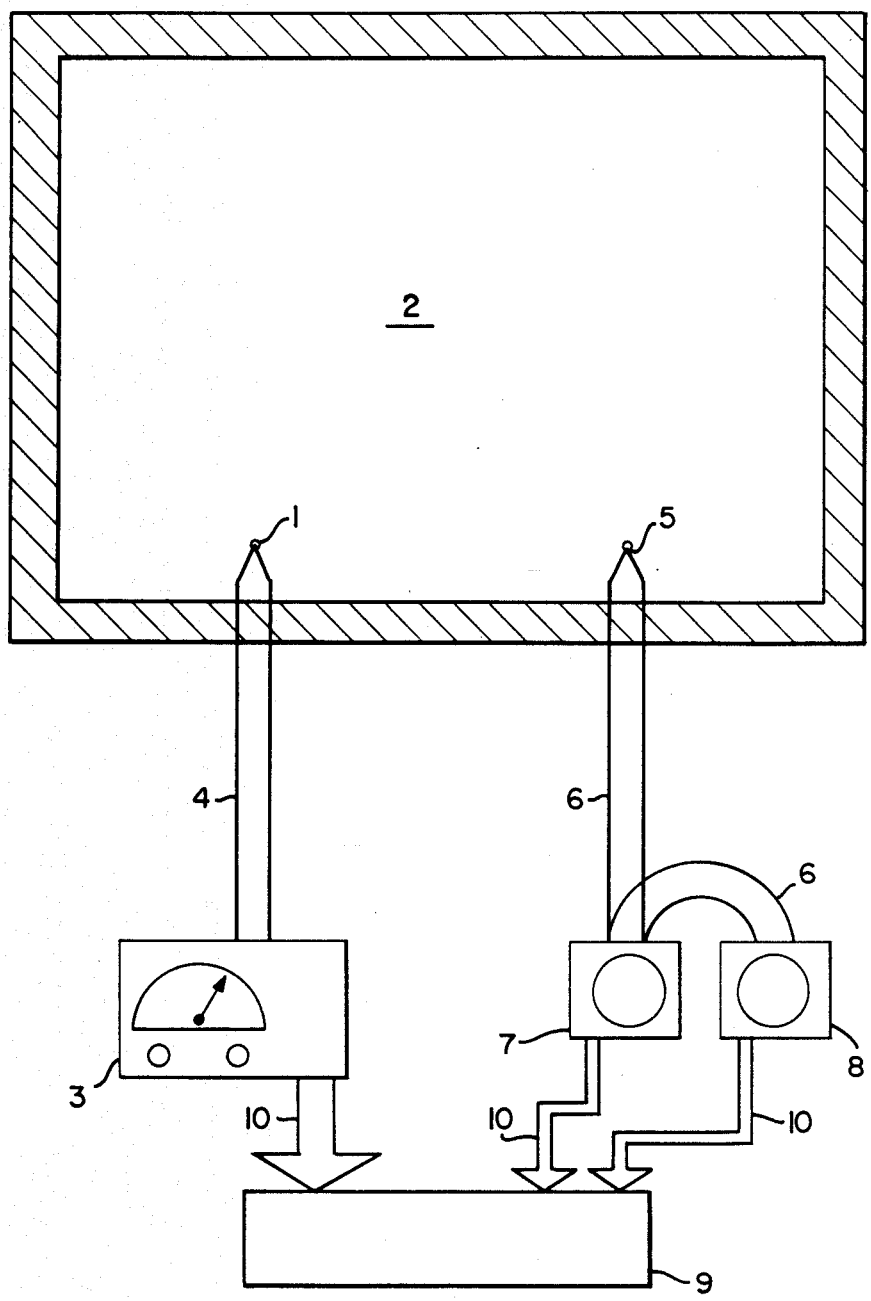
2
1
5
4
6
6
7
8
3
10
10
10
9

FURNACE TEMPERATURE SAFETY SYSTEM

TECHNICAL FIELD

This invention relates generally to the field of furnace temperature control and, in particular, is a system to allow monitoring of furnace temperature to improve furnace safety.

BACKGROUND ART

The purpose of any furnace is to provide an environment at a certain temperature or temperature range for the processing of material. It is important for the proper functioning of a furnace that the temperature be maintained at the desired level. A common means to accomplish this is to determine the furnace temperature with a thermocouple connected to a furnace temperature controller which can increase or decrease the heat input to the furnace. If the thermocouple reads a furnace temperature less than the operating or desired temperature, the furnace temperature controller increases the heat input, and conversely if the thermocouple reads a furnace temperature greater than the operating temperature, the furnace temperature controller decreases the heat input.

Because the thermocouple is physically within the furnace and subjected to high heat, it is very susceptible to failure. Failure, such as by shorting out of the thermocouple, may cause the thermocouple to falsely give an ambient temperature or other low temperature reading even though the actual furnace temperature is within the operating range. In this situation the furnace temperature controller will continually increase the heat input to the furnace because of the false indication that the furnace is below the operating temperature. If left unchecked the temperature of the furnace will continually increase until the temperature exceeds the design limit of the furnace and catastrophic results occur.

In order to avoid such a potentially catastrophic situation, furnace operators generally provide a second safety thermocouple connected to a high temperature controller which is capable of completely shutting down the furnace if a dangerously high temperature is reached within the furnace. Thus, in the event the first furnace temperature control thermocouple fails and gives a false low temperature reading, the furnace temperature will rise only to the preset high cutoff temperature at which point the safety circuit will shut off the heating system.

The above-described conventional system is effective but has certain disadvantages. One disadvantage is that the furnace temperature must increase all the way to the high cutoff temperature before the failure of the temperature control thermocouple can be detected. Another disadvantage is that there is no effective way to check the integrity of the second safety thermocouple except for frequent manual checking of this thermocouple. Thus the situation may arise that the safety thermocouple is not operating correctly but the condition goes undetected because the control thermocouple system keeps the furnace temperature within the proper operating range. However, should the control thermocouple now fail, the furnace temperature would increase and the inoperable safety thermocouple could not shut down the furnace.

It is thus desirable to have a furnace temperature safety system which can overcome the disadvantages of the conventional system.

Accordingly, it is an object of this invention to provide a furnace temperature safety system which can detect a failed control thermocouple without the need for the furnace temperature to increase to a high enough temperature to trip the safety thermocouple system.

It is another object of this invention to provide a furnace temperature safety system which can detect a failed safety thermocouple without need for frequent manual safety checks of the thermocouple integrity.

SUMMARY OF THE INVENTION

The above and other objects, which will become apparent to one skilled in the art upon a reading of this disclosure, are attained by the present invention which is:

Furnace temperature safety system comprising:

(a) first thermocouple means for sensing temperature within a furnace, and means to transmit a signal corresponding to its sensed temperature to furnace temperature reading means;

(b) second thermocouple means for sensing temperature within a furnace, and means to transmit a signal corresponding to its sensed temperature in parallel to both low temperature reading means and high temperature reading means; and (c) means to transmit the reading from each of the furnace temperature, low temperature, and high temperature reading means to a signal comparator capable of comparing the three readings and making a logical decision based on their present values.

As used herein, the term "signal" means an electric or pneumatic potential, i.e. an electric voltage or current or a pneumatic pressure or flow, whose magnitude is representative of the temperature sensed by the temperature reading means.

As used herein, the term "signal comparator" means a device capable of determining if the magnitude of one input signal is greater than, less than, or equal to the magnitude of a second input signal, and then providing an indication of the result of the comparison.

As used herein, the term "in parallel" means when two or more devices are connected or arranged so that they each receive an identical input signal from a single signal source.

As used herein, the term "thermocouple" means two wires composed of dissimilar metals joined at the tip so that a thermoelectric voltage exists between the two wires which is proportional to the temperature of the junction of the two metals.

As used herein, the term "programmable logic controller" means a digitally operating electronic system designed for use in an industrial environment, which uses a programmable memory for the internal storage of user-oriented instructions to implement specific functions, such as logic sequencing, timing, counting, and arithmetic to control, through digital or analog inputs and outputs, various types of machines or processes.

BRIEF DESCRIPTION OF THE DRAWING

The sole FIGURE is a simplified schematic representation of one preferred embodiment of the furnace temperature safety system of this invention.

DETAILED DESCRIPTION

The furnace temperature safety system of this invention will be described in detail with reference to the Drawing.

Referring now to the FIGURE, first thermocouple means 1 is within furnace zone 2 and is capable of sensing the temperature within the furnace. Thermocouple suitable for use as the first or control thermocouple means of this invention are well known to practitioners of this art and are commercially available. Examples of commercially available thermocouples include platinum versus platinum—10% rhodium (Type S), nickel chromium versus nickel aluminum (Type K), and platinum versus platinum—13% rhodium (Type R).

Thermocouple 1 is capable of sending a signal to furnace temperature reading means 3. The signal may be an electrical signal, a pneumatic signal, or any other effective signal. The signal may be transmitted by any suitable transmission means. In the embodiment of the FIGURE the signal is an electrical signal and is transmitted by transmission means 4 which, in this case, is thermocouple extension wire.

The electrical signal transmitted from thermocouple 1 to reading means 3 corresponds to the temperature sensed by thermocouple 1. Reading means 3 converts the signal into standard units for temperature readings such as degrees Fahrenheit or Celsius. Temperature readers suitable for use as the furnace temperature reading means of this invention are well known to practitioners of this art and are commercially available. Examples of commercially available temperature readers include thermocouple input modules for various brands of programmable logic controllers, digital thermocouple thermometers, and digital thermocouple controllers.

The furnace temperature reader preferably controls the heat input to the furnace. If the furnace temperature reading is below the preset furnace temperature operating range, reader 3 causes heat input to the furnace to increase and vice versa. This is accomplished within the reader by comparing the thermocouple temperature to the preset operating temperature. The output from the controller is connected to a fuel or oxidant valve, and the valve is opened or closed based on the difference between the thermocouple temperature and the preset temperature detected by the thermocouple reader. This introduces more or less fuel into the furnace and hence controls the heat input to the furnace.

Within furnace zone 2 is second or safety thermocouple means 5 which may be, and preferably is the same type of thermocouple as thermocouple 1. Safety thermocouple 5 is capable of sensing the temperature within the furnace and transmitting a signal corresponding to its sensed temperature, such as by transmission means 6, to both low temperature reading means 7 and high temperature reading means 8. Transmission means 6 is preferably the same type as transmission means 4. The signal transmission from safety thermocouple 5 to temperature reading means 7 and 8 is in parallel so that each of temperature reading means 7 and 8 receive the same temperature signal from safety thermocouple 5 independently of the other.

Low temperature and high temperature readers suitable for use with this invention are well known to practitioners of this art and are commercially available. Examples of commercially available readers include digital temperature controllers, single setpoint on-off controllers, and high limit controllers with manual reset.

Low temperature reader 7 is preset at a low temperature corresponding to a temperature below which operation of the furnace is not considered safe. When the furnace is turned on, the temperature within the furnace rises from ambient, past the low safe temperature and into the operating range at which point low temperature reader 7 is turned on.

High temperature reader 8 is preset at a high temperature corresponding to a temperature above which operation of the furnace is not considered safe. If the furnace temperature should ever exceed this temperature, high temperature reader 8 would turn off all heat input into the furnace thus preventing destruction of the furnace. This is accomplished by wiring high temperature reader 8 in series with the fuel and oxidant safety shut off valves so that when the controller turns on, the valves are de-energized and close.

Furnace temperature reader 3 transmits its temperature reading to signal comparator 9. Preferably signal comparator 9 is a programmable logic controller. Commercially available programmable logic controllers include Texas Instruments 530, Texas Instruments PM 550, Allen-Bradley PLC 2, Allen-Bradley PLC 3/10, and Modicon 584. The transmission is by transmission means 10 which may be any suitable means such as electrical or pneumatic transmission means. In the embodiment of the FIGURE transmission means 10 is electrical. Electrical transmission may be either digital or analog. In the embodiment of the FIGURE, low temperature reader 7 and high temperature reader 8 transmit their above or below set point indication by digital electrical signals through transmission means 10 to signal comparator 9. Signal comparator 9 compares the temperature reading from furnace temperature reader 3 and the indications from temperature readers 7 and 8, and can recognize a condition corresponding to a failed thermocouple.

In operation, and assuming a failed control thermocouple 1 giving a false low reading causing furnace temperature reader 3 to continually increase heat input to the furnace, once the furnace temperature passes the low setpoint or preset low temperature, low temperature reader 7 will turn on and send an indication to signal comparator 9 that the furnace temperature is above the low limit. The discrepancy between the temperature indication from low temperature reader 7 and the false low reading from furnace temperature reader 3 would indicate that control thermocouple 1 has failed, thus enabling recognition and correction of this condition without need for the furnace to reach the high setpoint or preset high temperature.

In operation, and assuming a failed safety thermocouple 5 giving a false low reading, once the furnace temperature passes the low setpoint, furnace temperature reader 3 will transmit the furnace temperature to signal comparator 9 but low temperature reader 7 will not have turned on. This discrepancy would indicate that safety thermocouple 5 has failed, thus enabling recognition and correction of this condition before any dangerously high furnace temperature could be reached.

Typical low setpoint temperatures are within the range of from 1400° to 1600° F. and typical high setpoint temperatures are within the range of from 2200° to 2550° F.

Now by the use of the furnace temperature safety system of this invention, comprising a low furnace temperature reader connected in parallel with the high furnace temperature reader to a single safety thermocouple, one can easily monitor the integrity of both the control and safety thermocouples without need for frequent manual checks, thus increasing the safety of the furnace operation.

Although the furnace temperature safety system of this invention has been described in detail with reference to a certain preferred embodiment, those skilled in the art will recognize that there are other embodiments of this invention within the spirit and scope of the claims. For example, the furnace temperature safety system of this invention is applicable for use with electrically heated furnaces as well as with fuel fired furnace as described in detail herein.

I claim:

1. Furnace temperature safety system comprising:

(a) first thermocouple means for sensing temperature within a furnace, and means to transmit a signal corresponding to its sensed temperature to furnace temperature reading means;

(b) second thermocouple means for sensing temperature within a furnace, and means to transmit a signal corresponding to its sensed temperature in parallel to both low temperature reading means and high temperature reading means; and (c) means to transmit the temperature reading from each of the furnace temperature, low temperature, and high temperature reading means to a signal comparator capable of comparing the three readings and making a logical decision based on their present values.

2. The system of claim 1 wherein at least one of the thermocouple means is of the platinum versus platinum—10% rhodium type.

3. The system of claim 1 wherein at least one of the thermocouple means is of the nickel-chromium versus nickel-aluminum type.

4. The system of claim 1 wherein at least one of the thermocouple means is of the platinum versus platinum—13% rhodium type.

5. The system of claim 1 wherein at least one signal transmission from a thermocouple means is electrical.

6. The system of claim 5 wherein the electrical transmission is by thermocouple extension wire.

7. The system of claim 1 wherein the furnace temperature reading means is a thermocouple input module for a programmable controller.

8. The system of claim 1 wherein at least one of the low temperature and high temperature reading means is a digital temperature controller.

9. The system of claim 1 wherein the signal comparator is a programmable logic controller.

10. The system of claim 1 wherein at least one transmission means to the signal comparator is electrical transmission means.

11. The system of claim 1 wherein the low temperature reading means is set a temperature setpoint within the range of from 1400° to 1600° F.

12. The system of claim 1 wherein the high temperature reading means is set at a temperature setpoint within the range of from 2200° to 2550° F.

13. The system of claim 1 wherein the furnace temperature reading means is a digital thermocouple thermometer.

14. The system of claim 1 wherein the furnace temperature reading means is a digital thermocouple controller.

15. The system of claim 1 wherein at least one of the low temperature and high temperature reading means is a single set point on-off controller.

16. The system of claim 1 wherein at least one of the low temperature and high temperature reading means is a high limit controller with manual reset.

* * * * *